US010179450B2

(12) United States Patent
Kinoshita

(10) Patent No.: US 10,179,450 B2
(45) Date of Patent: Jan. 15, 2019

(54) LIQUID DISCHARGE HEAD

(71) Applicant: SEIKO EPSON CORPORATION, Tokyo (JP)

(72) Inventor: Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/804,668

(22) Filed: Nov. 6, 2017

(65) Prior Publication Data

US 2018/0126733 A1 May 10, 2018

(30) Foreign Application Priority Data

Nov. 7, 2016 (JP) ..... 2016-216984

(51) Int. Cl.
*B41J 2/14* (2006.01)

(52) U.S. Cl.
CPC ..... *B41J 2/14201* (2013.01); *B41J 2/14024* (2013.01); *B41J 2/14233* (2013.01); *B41J 2002/14241* (2013.01); *B41J 2002/14419* (2013.01); *B41J 2002/14491* (2013.01); *B41J 2202/19* (2013.01); *B41J 2202/20* (2013.01)

(58) Field of Classification Search
CPC ..... A01B 12/006; B41J 2002/14419; B41J 2202/19; B41J 2202/20
See application file for complete search history.

(56) References Cited

U.S. PATENT DOCUMENTS

| | | | | |
|---|---|---|---|---|
| 8,360,563 | B2 * | 1/2013 | Shimizu | B41J 2/055 347/22 |
| 9,050,803 | B2 * | 6/2015 | Koda | B41J 2/1433 |
| 9,694,581 | B2 * | 7/2017 | Yoshida | B41J 2/14274 |
| 2015/0202866 | A1 | 7/2015 | Akahane | |

FOREIGN PATENT DOCUMENTS

| | | |
|---|---|---|
| JP | 06-036620 | 2/1994 |
| JP | 2010-076165 | 4/2010 |
| JP | 2015-136866 | 7/2015 |

* cited by examiner

*Primary Examiner* — Lamson Nguyen
(74) *Attorney, Agent, or Firm* — Workman Nydegger

(57) ABSTRACT

A liquid discharge head includes a first electrical contact and a second electrical contact disposed apart from each other, a flexible wire connecting the first electrical contact and the second electrical contact to each other, and a drive element configured to generate a driving force for discharging liquid from nozzles in accordance with an electrical signal supplied via the first electrical contact, the flexible wire, and the second electrical contact. The flexible wire has a folded portion being folded when viewed in the width direction of the flexible wire.

20 Claims, 13 Drawing Sheets

LIQUID DISCHARGE HEAD

BACKGROUND

1. Technical Field

The present invention relates to a technique for discharging a liquid such as ink.

2. Related Art

Liquid discharge heads that drive a drive element to discharge liquid such as ink from a plurality of nozzles toward a medium such as paper have been provided. If the nozzles are misaligned in the manufacturing process, the positions on the medium at which the liquid lands may differ from the positions on the medium at which the liquid is intended to land. To solve the problem, for example, JP-A-2015-136866 proposes to adjust the positions of nozzles by adjusting the position of a head in the height direction by disposing a spacer between a head fixing substrate and the head.

To supply electric power for driving a drive element, some apparatuses use an elastic flexible wire. The flexible wire connects an electrical contact (connector) of a circuit board provided on a head fixing board and an electrical contact (connector) of a head. In such a configuration, if the relative positions of the electrical contacts are misaligned, bending stress corresponding to bending rigidity due to the misalignment of positions of the electrical contacts is produced in the flexible wire. Accordingly, even if the head is fixed to the head fixing board by adjusting the height of the head by the spacer as in JP-A-2015-136866, when the relative positions of the electrical contacts are changed due to a mounting error of the circuit board or the like, the electrical contacts are subjected to the reaction force due to the bending stress of the flexible wire and the head may be deformed to cause a deviation in nozzle positioning (for example, misalignment).

SUMMARY

An advantage of some aspects of the invention is that the reaction force of a flexible wire applied to electrical contacts is reduced even if relative positions of the electrical contacts are changed.

To solve the above-mentioned problem, a liquid discharge head according to an aspect of the invention includes a first electrical contact and a second electrical contact disposed apart from each other, a flexible wire connecting the first electrical contact and the second electrical contact to each other, and a drive element configured to generate a driving force for discharging liquid from nozzles in accordance with an electrical signal supplied via the first electrical contact, the flexible wire, and the second electrical contact. The flexible wire has a folded portion being folded when viewed in the width direction of the flexible wire. According to this aspect, even if the first electrical contact and the second electrical contact are relatively misaligned, the folded portion of the flexible wire is easily moved according to the amount of the misalignment of positions, and thereby the bending stress generated in the flexible wire can be reduced. Accordingly, the reaction force of the flexible wire applied to the electrical contacts can be reduced.

In this aspect, it is preferable that the folded portion have two mountain-folded portions and a valley-folded portion provided therebetween when viewed in the width direction of the flexible wire, and the fold of the valley-folded portion move in accordance with the relative positions of the folds of the two mountain-folded portions. According to this aspect, when the first electrical contact and the second electrical contact are relatively misaligned and the relative positions of the folds of the two mountain-folded portions are changed, the valley-folded portion moves in accordance with the relative positions. Consequently, the bending stress generated in the flexible wire can be more easily reduced than a structure in which no valley-folded portion is provided. Accordingly, the reaction force of the flexible wire applied to the electrical contacts can be reduced.

In this aspect, it is preferable that if a first direction and a second direction are orthogonal to each other when viewed in the width direction of the flexible wire, when the relative positions of the folds of the two mountain-folded portions are changed in the first direction, the fold of the valley-folded portion move in the second direction. According to this aspect, if the electrical contacts are relatively misaligned in the first direction in which the two mountain-folded portions tend to deform in the first direction, the fold of the valley-folded portion moves in the second direction, and thereby the bending stress generated in the flexible wire can be easily reduced.

In this aspect, it is preferable that in the second direction, the folds of the two mountain-folded portions be disposed apart, and in the first direction, the fold of the valley-folded portion be on the opposite side of the folds of the two mountain-folded portions with the first electrical contact therebetween. According to this aspect, the length from the folds of the mountain-folded portions to the fold of the valley-folded portion is increased in the first direction, and thereby the folded portion can be easily folded. Consequently, the ease of assembly of the liquid discharge head can be increased.

In this aspect, it is preferable that in the second direction, the folds of the two mountain-folded portions be disposed apart, and in the second direction, the folds of the two mountain-folded portions be between the first electrical contact and the second electrical contact. According to this aspect, in the second direction, the two folded portions are between the first electrical contact and the second electrical contact, and thereby the size of the liquid discharge head can be reduced. Furthermore, compared with a structure in which the fold of the valley-folded portion is located on the opposite side of the two mountain-folded portions with the first electrical contact therebetween in the first direction, the fold of the valley-folded portion can be easily moved. Consequently, the effect of reducing the reaction force of the flexible wire applied to the electrical contacts can be increased. With this structure, even if the electrical contacts are misaligned largely, the reaction force of the flexible wire applied to the electrical contacts can be reduced.

In this aspect, it is preferable that a plurality of wiring structures each including the first electrical contact, the second electrical contact, and the flexible wire be provided, and the first electrical contacts in the wiring structures be provided on a common circuit board. According to this aspect, the wires for electrical signals can be distributed among the flexible wires in the plurality of wiring structures; consequently, compared with a case in which a wire for electrical signals is provided in a flexible wire in only a single wiring structure, the heat generation can be dispersed.

In this aspect, it is preferable that the liquid discharge head further include a plurality of liquid discharge units each including the nozzles and the drive element, and a support supporting the liquid discharge units. The first electrical contact is fixed to the support, and the second electrical contact is fixed to each of the liquid discharge units. According to this embodiment, the first electrical contacts that are connected by the flexible wires are fixed to the support, and the second electrical contacts are fixed to the respective liquid discharge units. With this structure, when the liquid discharge units are positioned with the nozzle surfaces as references with respect to the support, the relative positional variations in the first electrical contacts and the second electrical contacts can be absorbed by the flexible wires. Accordingly, the reaction force of the flexible wires applied to the electrical contacts of the liquid discharge units can be reduced.

In this aspect, it is preferable that, in the flexible wire, the rigidity of the folded portion be lower than that of an end portion connected to the first electrical contact and that of an end portion connected to the second electrical contact. Accordingly, the rigidity of the folded portion is lower than that in the end portion connected to the first electrical contact and that in the end portion connected to the second electrical contact, and thereby the folded portion can be easily folded. Accordingly, the effect of reducing the reaction force of the flexible wire applied to the electrical contacts can be increased.

BRIEF DESCRIPTION OF THE DRAWINGS

The invention will be described with reference to the accompanying drawings, wherein like numbers reference like elements.

DESCRIPTION OF EXEMPLARY EMBODIMENTS

Liquid Discharge Head

Figure 1:
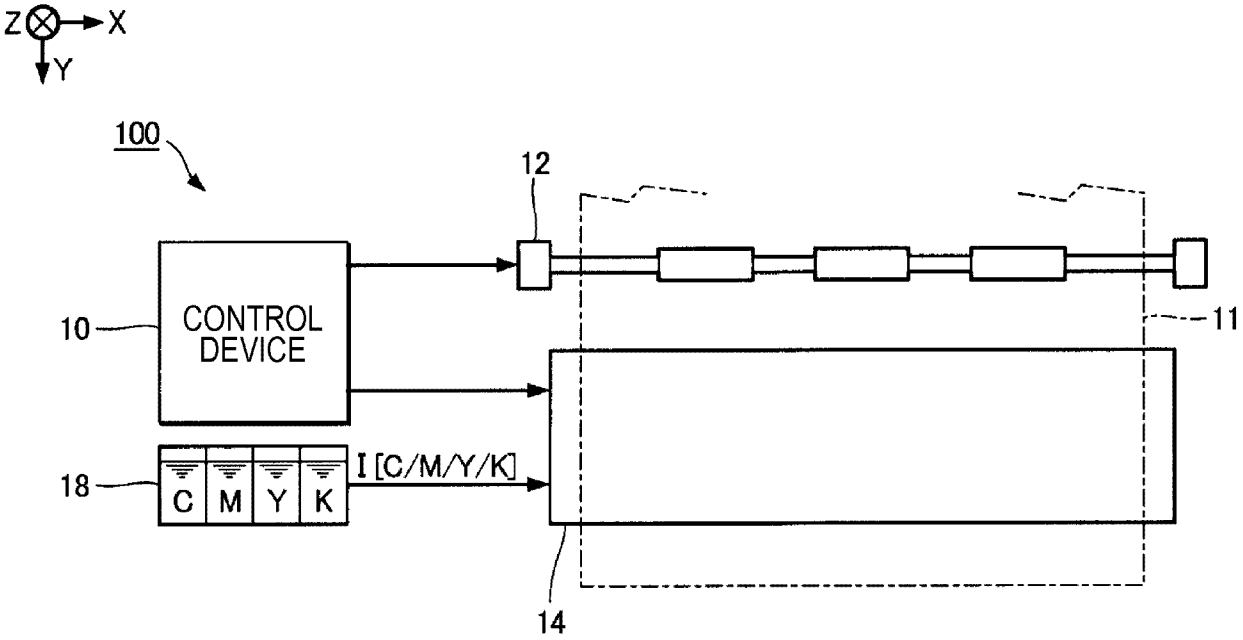
FIG. 1 illustrates a structure of a liquid discharge apparatus according to an embodiment of the invention.

FIG. 1 illustrates a partial structure of a liquid discharge apparatus 100 according to the embodiment of the invention. The liquid discharge apparatus 100 according to the embodiment is an ink jet printing apparatus that discharges ink, which is an example liquid, onto a medium 11 such as printing paper. The liquid discharge apparatus 100 is a liquid discharge apparatus that discharges ink, which is an example liquid, onto the medium (discharge target) 11 such as printing paper or the like. The liquid discharge apparatus 100 includes a control device 10, a transport mechanism 12, and a liquid discharge head 14. Liquid containers (ink cartridges) 18, which store inks I of a plurality of colors, are attached to the liquid discharge apparatus 100. In this embodiment, each of the liquid containers 18 stores a respective ink of the inks I, the respective ink having a color of cyan (C), magenta (M), yellow (Y), and black (K). It should be noted that the inks I are not limited to the inks of the plurality of colors and may be an ink of a single color.

Figure 2:
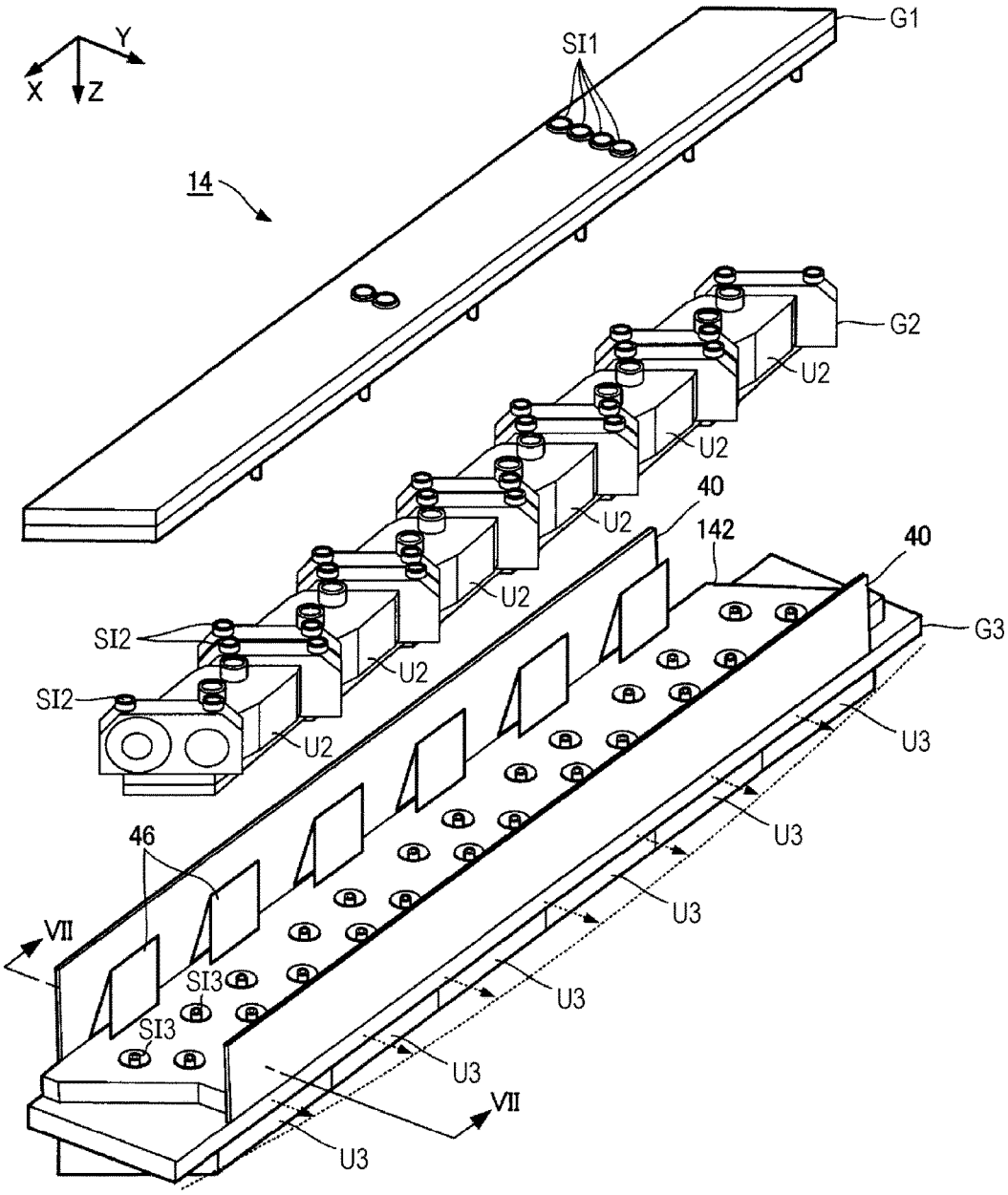
FIG. 2 is an exploded perspective view illustrating a liquid discharge head.
Figure 3:
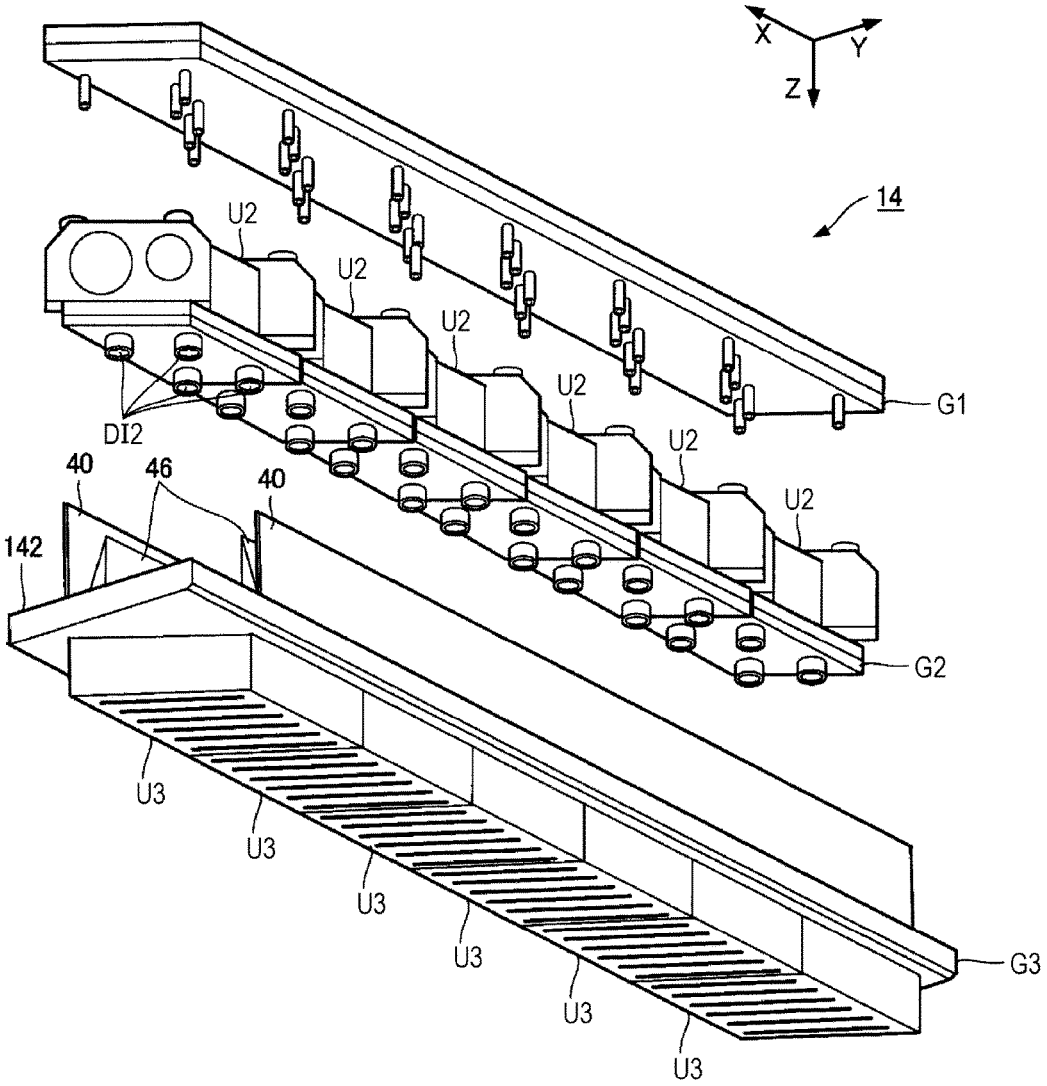
FIG. 3 is an exploded perspective view illustrating the liquid discharge head viewed from another angle.

The control device 10 performs overall control of components in the liquid discharge apparatus 100. The transport mechanism 12 transports the medium 11 in a Y direction under the control of the control device 10. However, the structure of the transport mechanism 12 is not limited to the above example. The liquid discharge head 14 discharges the inks I supplied from the liquid containers 18 onto the medium 11 under the control of the control device 10. The liquid discharge head 14 according to the embodiment is a line head that is elongated in an X direction that intersects the Y direction. In the following description, a direction orthogonal to an X-Y plane (plane parallel to the surface of the medium 11) is referred to as a Z direction. In other words, the Z direction is orthogonal to the X direction and also orthogonal to the Y direction. The direction toward which the liquid discharge head 14 discharges the inks I corresponds to the Z direction. Liquid discharge head FIG. 2 and FIG. 3 are exploded perspective views illustrating the structure of the liquid discharge head 14 illustrated in FIG. 1. As illustrated in FIG. 2 and FIG. 3, the liquid discharge head 14 includes a flow path structure G1, a flow path control section G2, and a liquid discharge section G3. The flow path structure G1, the flow path control section G2, and the liquid discharge section G3 are stacked in this order in the Z direction. The liquid discharge section G3 includes six liquid discharge units U3, a support 142, and circuit boards 40. The six liquid discharge units U3 are supported by the support 142 in the X direction.

The circuit board 40 is elongated in the X direction. The circuit board 40 includes a circuit that supplies a drive signal for driving a piezoelectric element 732, which will be described below, to each liquid discharge unit U3, and the like. In this embodiment, the two circuit boards 40 are fixed to respective side surfaces of the liquid discharge section G3. The circuit boards 40 are fixed in the X-Z plane. This embodiment includes the two circuit boards 40; however, the invention is not limited to this example, and a single circuit board 40 may be fixed to one of the side surfaces of the liquid discharge section G3.

Figure 4:
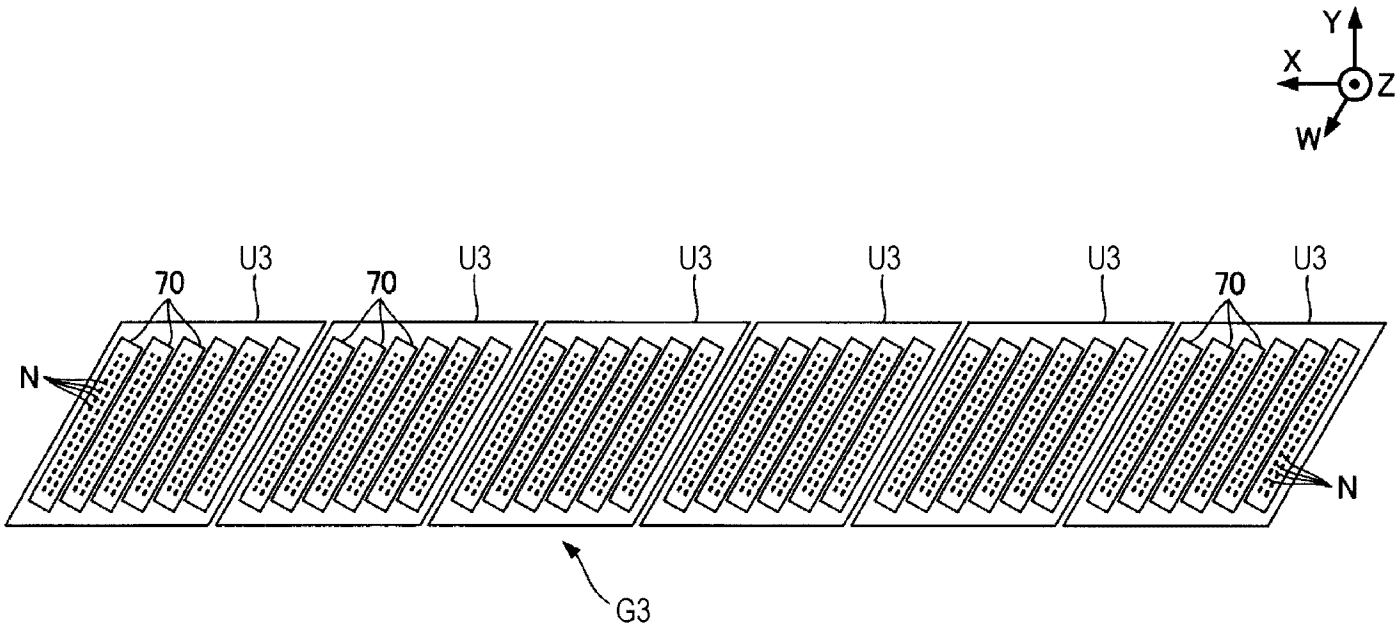
FIG. 4 is a plan view illustrating the liquid discharge head viewed from a medium side.

FIG. 4 is a plan view of a surface, which faces the medium 11, of the liquid discharge section G3. As illustrated in FIG. 4, the six liquid discharge units U3 are arranged in the X direction. Each liquid discharge unit U3 includes a plurality of (in this embodiment, six) discharge sections 70 that are arranged in the X direction. Each discharge section 70 includes a head chip for discharging the inks I from the nozzles N. The nozzles N in one discharge section 70 are arranged along two lines in a W direction inclined at predetermined angles with respect to the X direction and the Y direction. The four lines (corresponding to four colors) of inks I are disposed parallel to each discharge section 70 in the liquid discharge unit U3. The nozzles N in one discharge section 70 are divided into four groups, and each discharges a respective one of the inks I.

The four lines of inks I supply ink from the liquid containers 18 to the flow path structure G1. The flow path structure G1 distributes each of the four lines of inks I to six lines that correspond to the respective liquid discharge units U3. In other words, the number of lines (6) of inks I distributed by the flow path structure G1 exceeds the number of kinds K (K=4) of inks I.

The flow path control section G2 controls the flow paths (for example, opening and closing of the flow paths and control of pressure in the flow paths) in the liquid discharge head 14, and includes six flow path control units U2 that correspond to the respective liquid discharge units U3. The flow path structure G1 distributes each of the four lines of inks I to each of the six flow path control units U2. The respective flow path control units U2 control opening and closing of the flow paths and control pressure in the flow paths of the four lines of inks I, which have been distributed by the flow path structure G1 to the respective liquid discharge units U3.

After the distribution by the flow path structure G1, the four lines of inks I that have passed through the flow path control units U2 supply ink in parallel to the six liquid discharge units U3. As will be described below with reference to FIG. 5, each of the liquid discharge units U3 includes a liquid distribution section 60. The liquid distribution section 60 distributes the respective four lines of inks I supplied from the flow path control unit U2 of the preceding stage to the six lines that correspond to the respective discharge sections 70. In other words, the four lines of inks I, which have been distributed by the liquid distribution section 60, are supplied in parallel to the respective six discharge sections 70. Each of the discharge sections 70 discharges inks of the four lines from the corresponding nozzles N.

As illustrated in FIG. 2, four supply ports SI3 are provided on a surface, which faces the flow path control section G2, of each liquid discharge unit U3 in the liquid discharge section G3. Flow path tubes DI2, which are outlet flow paths for the flow path control units U2, are inserted into the corresponding supply ports SI3 in the respective liquid discharge units U3 in a state in which the flow path control section G2 and the liquid discharge section G3 (support 142) are fixed to each other. Consequently, the inks I of the corresponding lines are supplied in parallel from the flow path tubes DI2 in the corresponding flow path control units U2 to the four supply ports SI3 in the respective liquid discharge units U3.

Figure 5:
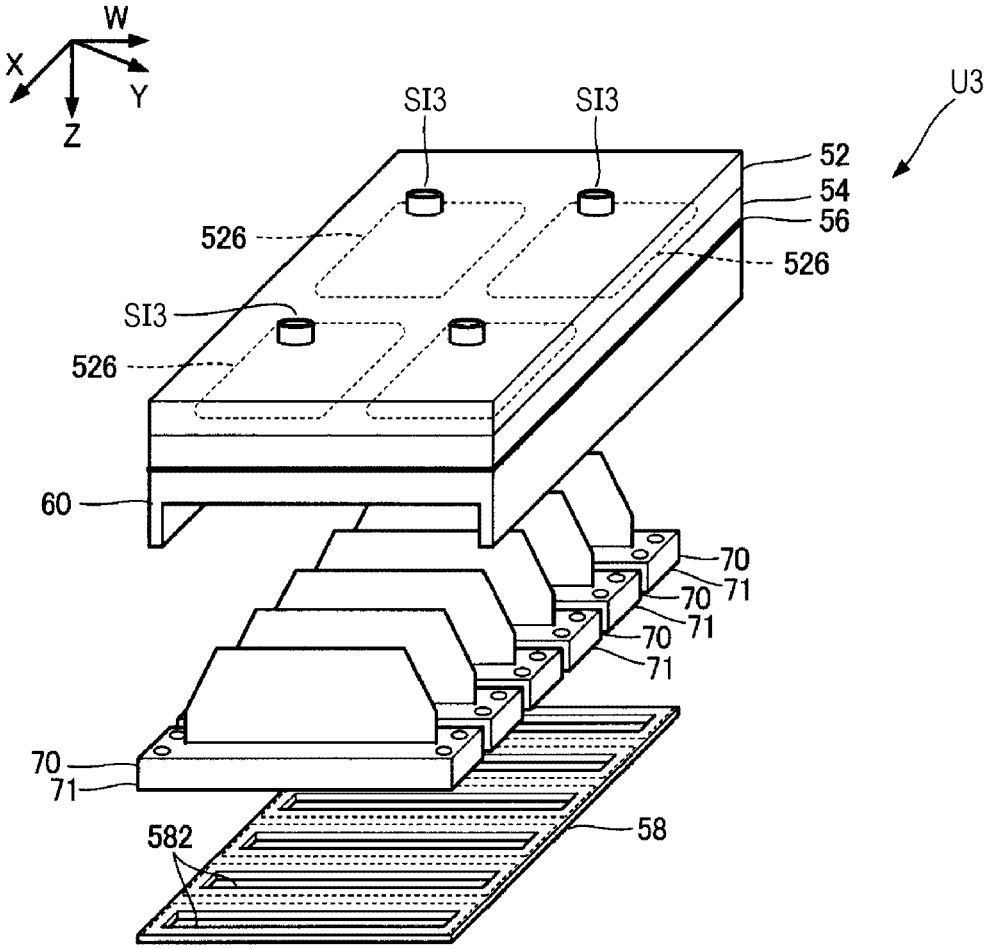
FIG. 5 is an exploded perspective view of the liquid discharge unit illustrated in FIG. 2.

FIG. 5 is an exploded perspective view of a liquid discharge unit U3. As illustrated in FIG. 5, the liquid discharge unit U3 has a laminate of a filter section 52, a communication member 54, a base wiring board 56, and the liquid distribution section 60, and the six discharge sections 70 that are fixed to a fixing board 58, the laminate and the discharge sections 70 are bonded together. The filter section 52 is used to remove bubbles and foreign matter contained in the inks I that are supplied from the flow path control section G2. As illustrated in FIG. 5, the filter section 52 has the four supply ports SI3, to which corresponding inks I that have passed through the flow path control section G2 are supplied, and four filters 526 that correspond to the inks I that are supplied from the supply ports SI3. The communication member 54 communicates with the four flow outlets of the filter section 52 and the liquid distribution section 60. The communication member 54 is a flat-plate material formed of an elastic material (for example, rubber). The liquid distribution section 60 distributes each of the respective four lines of inks I supplied via the communication member 54 to the six lines corresponding to the respective discharge sections 70.

An individual wiring board 78 is bonded to each discharge section 70. The individual wiring board 78 is inserted into an insertion slot (not illustrated) that is provided in the liquid distribution section 60 and bonded to the base wiring board 56. The individual wiring board 78 is a flexible wiring board for electrically connecting the base wiring board 56 and the corresponding discharge section 70. The fixing board 58 is a flat plate-like member that supports the discharge sections 70, and is formed of a high-rigid metal such as stainless steel, for example. As illustrated in FIG. 5, six openings 582, which correspond to the respective discharge sections 70, are provided on the fixing board 58. Each opening 582 is a substantially rectangular through-hole that is elongated in the W direction in plan view.

Figure 6:
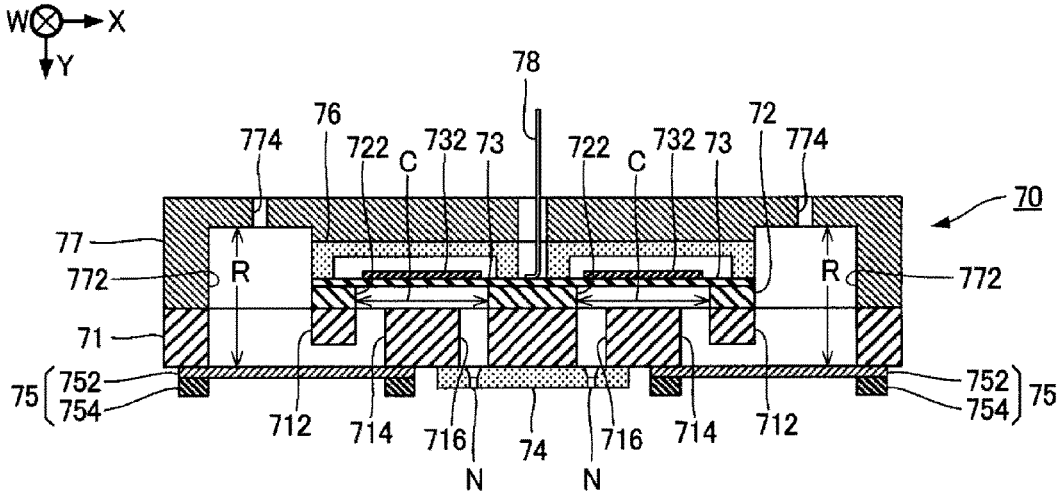
FIG. 6 is a cross-sectional view of the discharge head section illustrated in FIG. 5.

Each of the six discharge sections 70 in FIG. 5 discharges inks I of the four lines, which have been supplied from the liquid distribution section 60, from the nozzles N. FIG. 6 is a cross-sectional view (section that is perpendicular to the W direction) of a discharge section 70. As illustrated in FIG. 6, the discharge section 70 according to the embodiment has a pressure chamber forming substrate 72 and a diaphragm 73, which are laminated on one surface of the flow path forming substrate 71, and a head chip that has a nozzle plate 74 and a compliance section 75, which are formed on the other surface. The nozzles N are provided on the nozzle plate 74. Accordingly, the surface of the nozzle plate 74 that faces the medium 11 serves as a nozzle surface on which the nozzles N are provided. Structures corresponding to the respective arrays of the nozzles N are substantially symmetrically provided on one discharge section 70, and in the following description, for convenience, the structure of the discharge section 70 will be described focusing on one array of the nozzles N. The six nozzle plates 74 expose from the corresponding six openings 582.

The flow path forming substrate 71 is a flat-plate material that defines the flow paths of the inks I. The flow path forming substrate 71 according to the embodiment has an opening 712, a supply flow path 714, and a communication flow path 716. The supply flow path 714 and the communication flow path 716 are provided for each nozzle N, and the opening 712 is continuous over a plurality of nozzles N that discharge the ink I of one line. The pressure chamber forming substrate 72 is a flat-plate material that defines a plurality of openings 722 that correspond to the respective nozzles N. The flow path forming substrate 71 and the pressure chamber forming substrate 72 are formed of, for example, a silicon single-crystal substrate.

The compliance section 75 in FIG. 6 is a mechanism for reducing (absorbing) the pressure fluctuation in the flow path in the discharge section 70, and includes a sealing plate 752 and a support 754. The sealing plate 752 is a flexible film-like member. The support 754 fixes the sealing plate 752 to the flow path forming substrate 71 such that the opening 712 and supply flow paths 714 in the flow path forming substrate 71 are sealed.

The diaphragm 73 is disposed on a surface, which is opposite to the side of the flow path forming substrate 71, of the pressure chamber forming substrate 72 in FIG. 6. The diaphragm 73 is a plate-like member that can elastically vibrate, and for example, includes a laminate of an elastic film formed of an elastic material such as silicon oxide and an insulating film formed of an insulating material such as zirconium oxide. The diaphragm 73 and the flow path forming substrate 71 face with each other with a space inside an opening 722, which is provided in the pressure chamber forming substrate 72. The space between the flow path forming substrate 71 and the diaphragm 73 inside the opening 722 serves as a pressure chamber (cavity) C for applying a pressure to the ink. A plurality of pressure chambers C are arranged in the W direction.

A plurality of piezoelectric elements 732 that correspond to the respective nozzles N are provided on the surface of the diaphragm 73 opposite to the pressure chamber forming substrate 72. The piezoelectric element 732 is a laminate of electrodes that face each other having a piezoelectric body therebetween. The piezoelectric element 732 vibrates together with the diaphragm 73 in response to the supply of a drive signal and thereby the pressure in the pressure chamber C is changed to cause the ink I in the pressure chamber C to be discharged from the nozzle N. Accordingly, the piezoelectric element 732 serves as a drive element that generates a driving force for discharging the ink from the nozzle Z. Each piezoelectric element 732 is sealed and protected by a protective plate 76 that is fixed to the diaphragm 73.

As illustrated in FIG. 6, a support 77 is fixed to the flow path forming substrate 71 and the protective plate 76. The support 77 is integrally formed, for example, by molding of a resin material. The support 77 according to the embodiment is provided with a space 772 that defines a liquid storage room (reservoir) R with the opening 712 of the flow path forming substrate 71, and a supply port 774 that communicates with the liquid storage room R. Each supply port 774 communicates with a corresponding flow outlet 60B of the liquid distribution section 60. With this structure, the ink I of each line that has been distributed by the liquid distribution section 60 is supplied from the flow outlet 60B via the supply port 774 in the discharge section 70 and stored in the liquid storage room R. The ink I stored in the liquid storage room R is distributed and filled in the respective pressure chambers C via the supply flow paths 714, and discharged from the pressure chambers C via the communication flow paths 716 and the nozzles N to the outside (medium 11 side).

An end portion of the individual wiring board 78 is bonded to the diaphragm 73. The individual wiring board 78 is a flexible board (flexible wiring board) on which wires for transmitting drive signals and power source voltages to the respective piezoelectric elements 732 are provided. The individual wiring board 78 is provided through the slit-like opening (not illustrated) in the protective plate 76 and the support 77 to protrude toward the side of the base wiring board 56.

Flexible Wire

Figure 7:
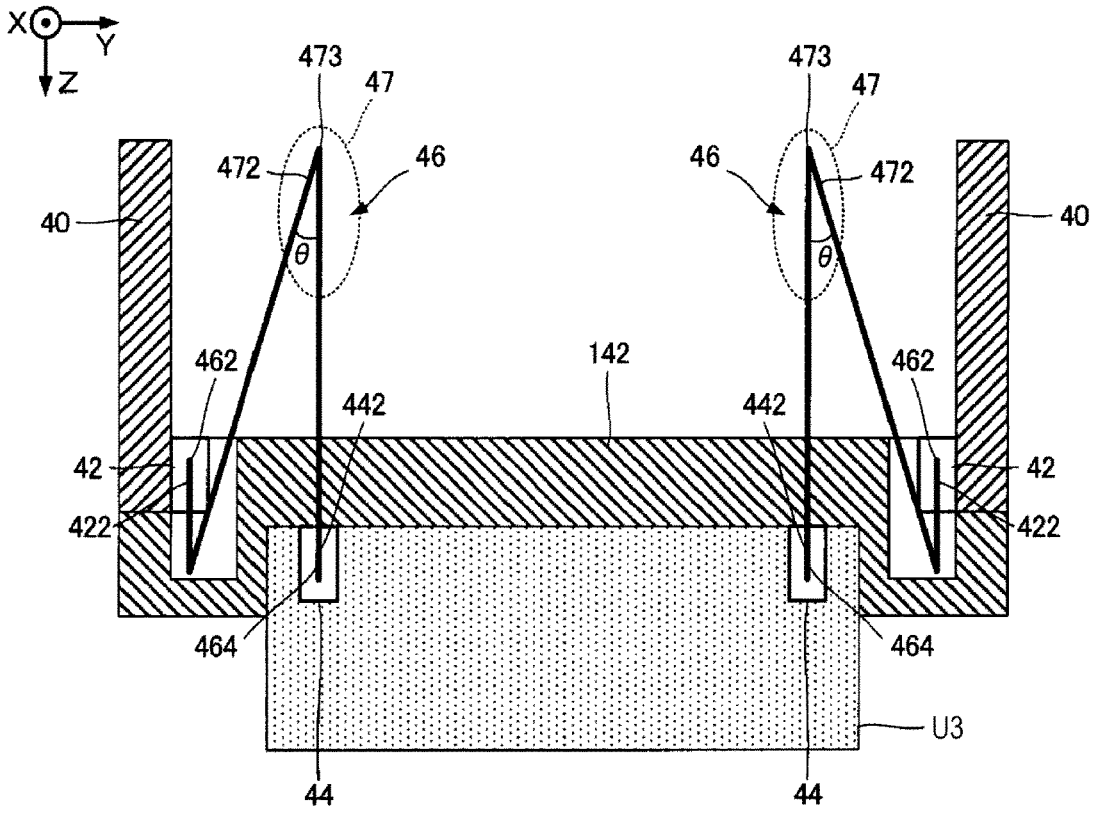
FIG. 7 is a cross-sectional view of the liquid discharge section illustrated in FIG. 2 taken along line VII-VII.
Figure 8:
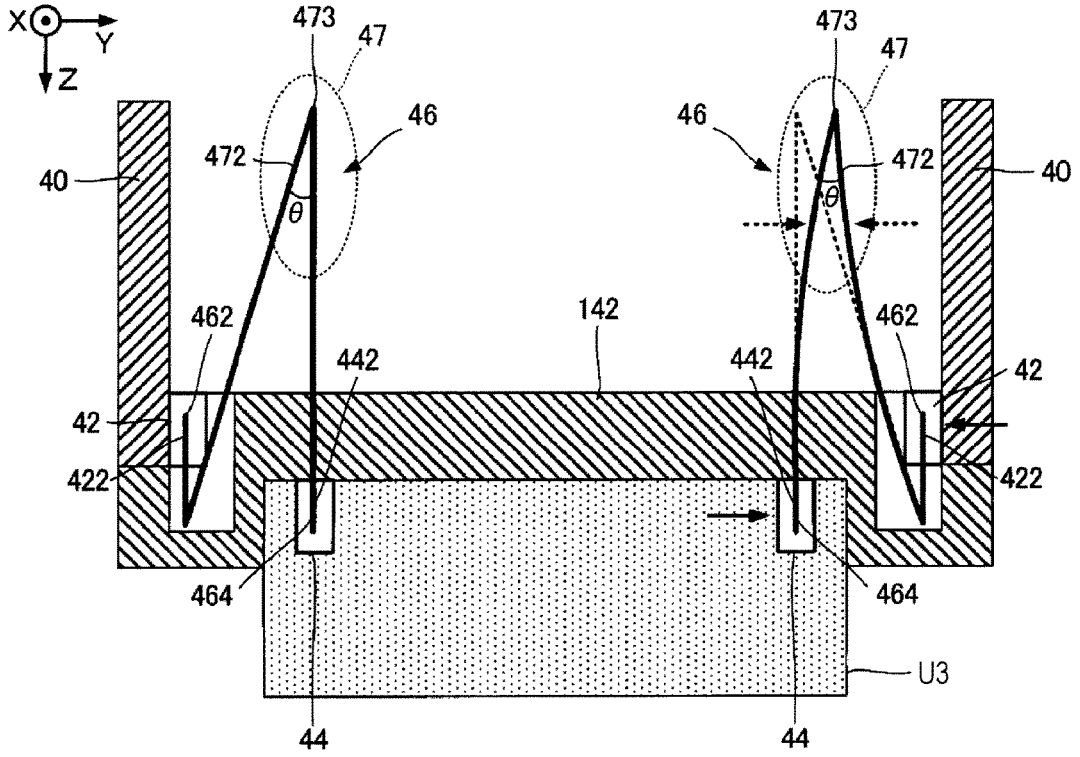
FIG. 8 is an explanatory view of an operation of the flexible wire illustrated in FIG. 7.

FIG. 7 is a cross-sectional view of the liquid discharge section G3 illustrated in FIG. 2 taken along line VII-VII. FIG. 8 is an explanatory view of an operation of the flexible wire 46 illustrated in FIG. 7. In FIG. 8, the dotted line indicates the flexible wire 46 before deformation and the solid line indicates the flexible wire 46 after deformation. As illustrated in FIG. 2 and FIG. 7, the support 142 in the liquid discharge section G3 has two circuit boards 40 that are provided upright. Each of the two circuit boards 40 is provided with six first electrical contacts (first connectors) 42 that have a plurality of connection terminals; twelve first electrical contacts 42 are provided in total on the two circuit boards 40. Six first electrical contacts 42 are provided on one common circuit board 40, and the other six first electrical contacts 42 are provided on the other common circuit board 40. Each of the six liquid discharge units U3 is provided with two second electrical contacts (second connectors) 44; twelve second electrical contacts 44 are provided in total in the six liquid discharge units U3.

The respective six first electrical contacts 42 on one circuit board 40 are connected to the second electrical contacts 44 in the six liquid discharge units U3 by six flexible wires 46 respectively. The respective six first electrical contacts 42 on the other circuit board 40 are connected to the second electrical contacts 44 in the six liquid discharge units U3 by six flexible wires 46 respectively. In other words, in this embodiment, if it is assumed that the first electrical contact 42, the second electrical contact 44, and the flexible wire 46 are one wiring structure set, a plurality of sets (in this embodiment, twelve sets in total) of wiring structures are arranged in the longitudinal direction of the liquid discharge section G3 in a total of two lines with six sets of wiring structures as one line.

With such a structure, the circuit boards 40 and the liquid discharge units U3 are electrically connected via the flexible wires 46, which are disposed apart from each other, and thereby the heat generated by the wires can be dispersed compared with a structure in which the circuit boards 40 and the liquid discharge units U3 are electrically connected via a single flexible wire 46. To each of the second electrical contacts 44, the individual wiring board 78 is connected via the above-described base wiring board 56. Accordingly, an electrical signal is supplied from the circuit board 40 to the liquid discharge unit U3 via the first electrical contact 42, the flexible wire 46, and the second electrical contact 44. In accordance with the electrical signal output from the circuit board 40, a drive signal is generated for each piezoelectric element 732 by a drive circuit (not illustrated) on the base wiring board 56, and the drive signal is supplied to the piezoelectric element 732 via the individual wiring board 78.

As illustrated in FIG. 2, each of the flexible wire 46 is a flexible wiring board that has a predetermined width in the X direction, and on the surface of the wiring board, one or more electrical signal wires are provided. As illustrated in FIG. 2 and FIG. 7, the flexible wire 46 according to the embodiment has a folded portion 47 that is folded when viewed in the width direction (X direction), an end portion 462 that is connected to the first electrical contact 42, and an end portion 464 that is connected to the second electrical contact 44. The first electrical contact 42 has an insertion slot 422, and the end portion 462 is inserted into the insertion slot 422 for connection. The second electrical contact 44 has an insertion slot 442, and the end portion 464 is inserted into the insertion slot 442 for connection. As illustrated in FIG. 7, the end portion 462 may be folded so as to be inserted into the insertion slot 422 of the first electrical contact 42.

The folded portion 47 according to the embodiment is a portion of the flexible wire 46; the portion has at least one fold (a fold in a mountain folded portion or a fold in a valley fold portion) that is bent such that the fold angle θ has an acute angle (0 degrees<θ<90 degrees), and when an external force is applied to the end portion 462 and the end portion 464 of the flexible wire 46, the folded portion 47 can be deformed (for example, deformed such that the fold angle θ becomes smaller) so as to be folded or the fold is moved and deformed to reduce the bending stress. The folded portion 47 according to the embodiment, when viewed in the width direction, has an inverted-V shape and has a mountain-folded portion 472 that is folded in the shape of mountain at a fold 473 such that the fold angle θ becomes an acute angle.

As described above, the flexible wire 46 according to the embodiment has the folded portion 47 which is folded when viewed in the width direction. Consequently, for example, if the relative positions of the first electrical contact 42 and the second electrical contact 44 are changed in the Y direction due to an installation error or the like as indicated by the solid arrows in FIG. 8, the folded portion 47 of the flexible wire 46 is moved so as to be folded to deform in the Y direction in accordance with the amount of the misalignment of positions. Accordingly, the bending stress generated in the flexible wire 46 can be reduced and the reaction force of the flexible wire 46 applied to the electrical contacts 42 and 44 can be reduced. Consequently, the deviation in the nozzles N in positioning (for example, misalignment) caused by the reaction force of the flexible wire 46 can be reduced.

Figure 9:
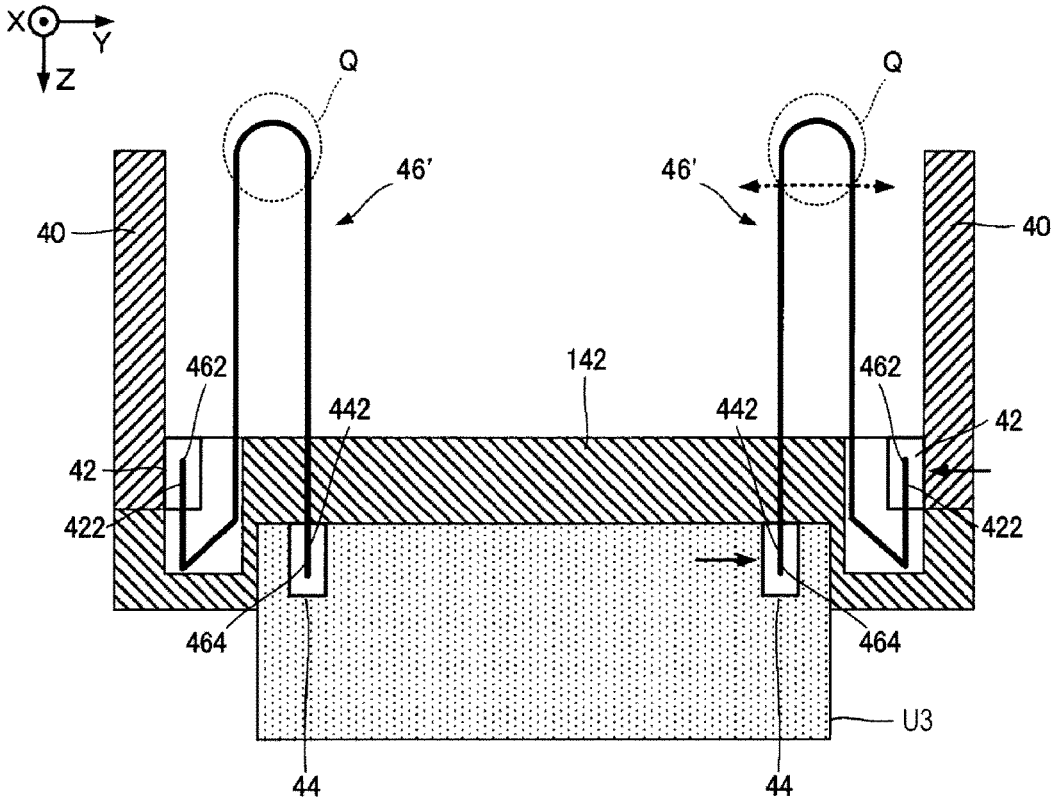
FIG. 9 illustrates a structure of a flexible wire according to a comparative example of the embodiment.

FIG. 9 illustrates a structure of a flexible wire 46' according to a comparative example of the embodiment and corresponds to FIG. 8. The flexible wire 46' is a specific example of a wiring board that has no folded portion 47, which is deformed so as to be folded at the fold. In other words, the flexible wire 46' is a specific example of a wiring board that has the flexible wire 46' in which a portion Q is bent in a curved shape and has no fold. In the structure in FIG. 9, when the first electrical contact 42 and the second electrical contact 44 are relatively misaligned as indicated by the solid arrows in FIG. 9, the portion Q of the flexible wire 46' is not easily deformed to fold. Accordingly, in the structure in FIG. 9, the second electrical contact 44 tends to receive a reaction force indicated by the dotted arrow in FIG. 9 due to the bending stress of the flexible wire 46'. Such a reaction force of the flexible wire 46' is transmitted to the first electrical contact 42 and the second electrical contact 44. By the transmitted reaction force, the liquid discharge unit U3 and the support 142 are relatively deformed and a deviation in the nozzles N in positioning occurs, and thereby misalignment or the like occurs in the arrays of the nozzles N.

The relative deformation of the liquid discharge units U3 and the support 142 tends to become larger toward a central portion in the X direction (longitudinal direction) in FIG. 2. For example, as illustrated in FIG. 2, if the liquid discharge units U3 and the support 142 are relatively deformed in the Y direction as indicated by the dotted arrows, the closer the nozzles N in the liquid discharge units U3 to the central portion in the X direction, the more the nozzles N become misaligned. Specifically, as indicated by the dotted line connecting the tips of the dotted arrows in FIG. 2, the relative deformation between the liquid discharge units U3 and the support 142 is largest at the central portion in the X direction and decreases from the central portion toward both end portions in the X direction. Consequently, the misalignment of the nozzles N becomes the largest at the central portion in the X direction.

As in the embodiment, in this structure in which the liquid discharge units U3 are fixed to the support 142 from below (the structure in which the upper surfaces of the liquid discharge units U3 are fixed to the support 142), the distance (distance in the Z direction) between the fixing surface of the liquid discharge units U3 with respect to the support 142 and the nozzle surface on the opposite side tends to be long. In such a case, if the support 142 is distorted, the misalignment of the nozzle surface becomes large. In other words, the longer the liquid discharge unit U3 is in the Z direction, the larger the misalignment of the nozzle surface due to the reaction force of the flexible wires 46, and thereby the misalignment of the nozzles N increases in the Y direction.

According to the embodiment, the bending stress of the flexible wires 46 generated in the structure in FIG. 9 can be reduced, and thereby the relative deformation between the support 142 and the liquid discharge units U3 can be reduced and the misalignment of the nozzles N can be reduced.

In this embodiment, the first electrical contacts 42 that are connected by the flexible wires 46 are fixed to the support 142 via the circuit boards 40, and the second electrical contacts 44 are fixed to the respective liquid discharge units U3. With this structure, when the six liquid discharge units U3 are positioned with the nozzle surfaces of the nozzle plates 74 as references with respect to the support 142, the relative positional variations between the first electrical contacts 42 and the second electrical contacts 44 can be absorbed by the flexible wires 46. Accordingly, the reaction force of the flexible wires 46 applied to the second electrical contacts 44 of the six liquid discharge units U3 can be reduced.

It should be noted that even if the relative deformation of the liquid discharge units U3 and the support 142 is very small, for example, on the order of several tens of micrometers, the deformation causes a large misalignment in the nozzles N having a diameter of about 20 μm, for example. Consequently, the effect of the embodiment of the invention is significant in that such relative deformation of the liquid discharge units U3 and the support 142 can be reduced and high-definition printing can be performed.

The above-described flexible wire 46 in FIG. 7 has the inverted-V shaped folded portion 47 having one mountain-folded portion 472; however, the structure is not limited to this example. For example, in a first modification of the embodiment illustrated in FIG. 10, the folded portion 47 may have two mountain-folded portions 472 that are bent in the shape of mountain at two folds 473 such that the fold angle θ become an acute angle and may have a valley-folded portion 474 that is bent in the shape of valley at a fold 475 between the mountain-folded portions 472 such that the fold angle θ becomes and acute angle, and the folded portions form an M shape when viewed in the width direction of the flexible wire 46. In the Y direction, the folds 473 of the two mountain-folded portions 472 are disposed apart. The respective two mountain-folded portions 472 are bent in one side and the other side of the valley-folded portion 474 with the valley-folded portion 474 therebetween.

Figure 10:
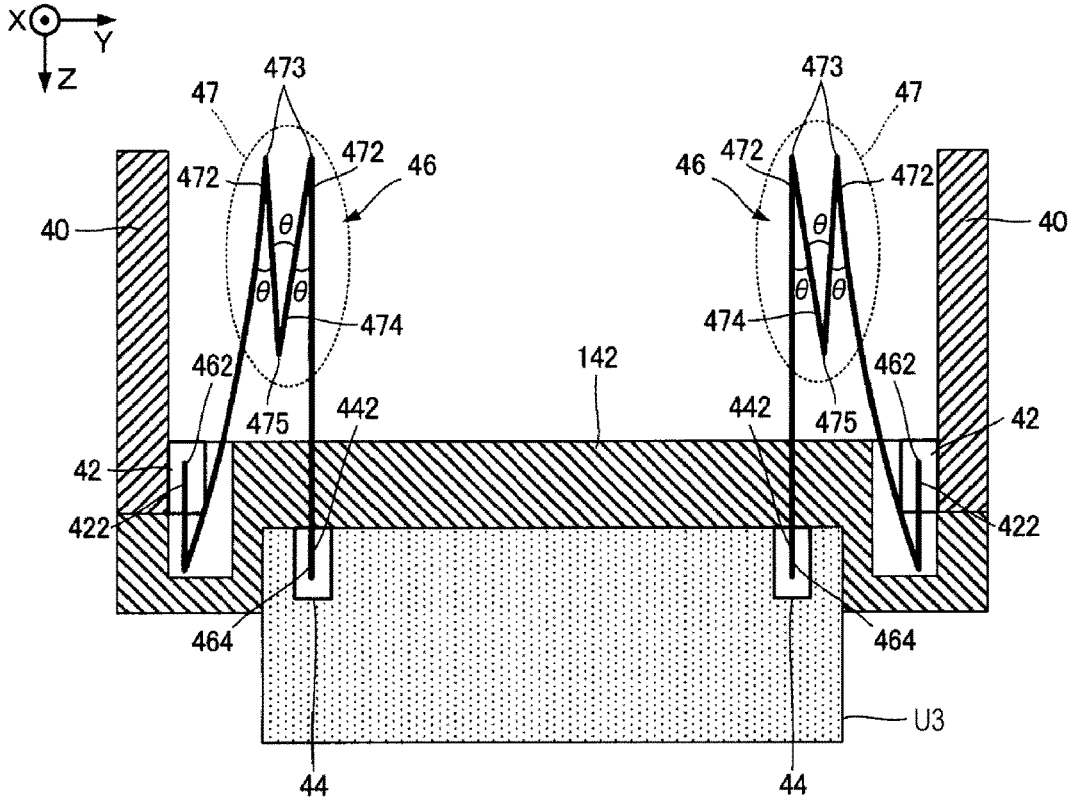
FIG. 10 illustrates a structure of a flexible wire according to a first modification.

The M-shaped folded portion 47 in FIG. 10 having such a structure can be deformed to fold in the folded portion 47 in accordance with the misalignment of the electrical contacts 42 and 44 and also can be deformed to move in accordance with relative positions of the folds 473 of the two mountain-folded portions 472. Consequently, if the electrical contacts 42 and 44 are relatively misaligned in the Z direction in which the folds 473 of the two mountain-folded portions 472 tend to deform in the Z direction, the fold 475 of the valley-folded portion 474 moves in the Y direction, and thereby the bending stress generated in the flexible wire 46 can be easily reduced.

Figure 11:
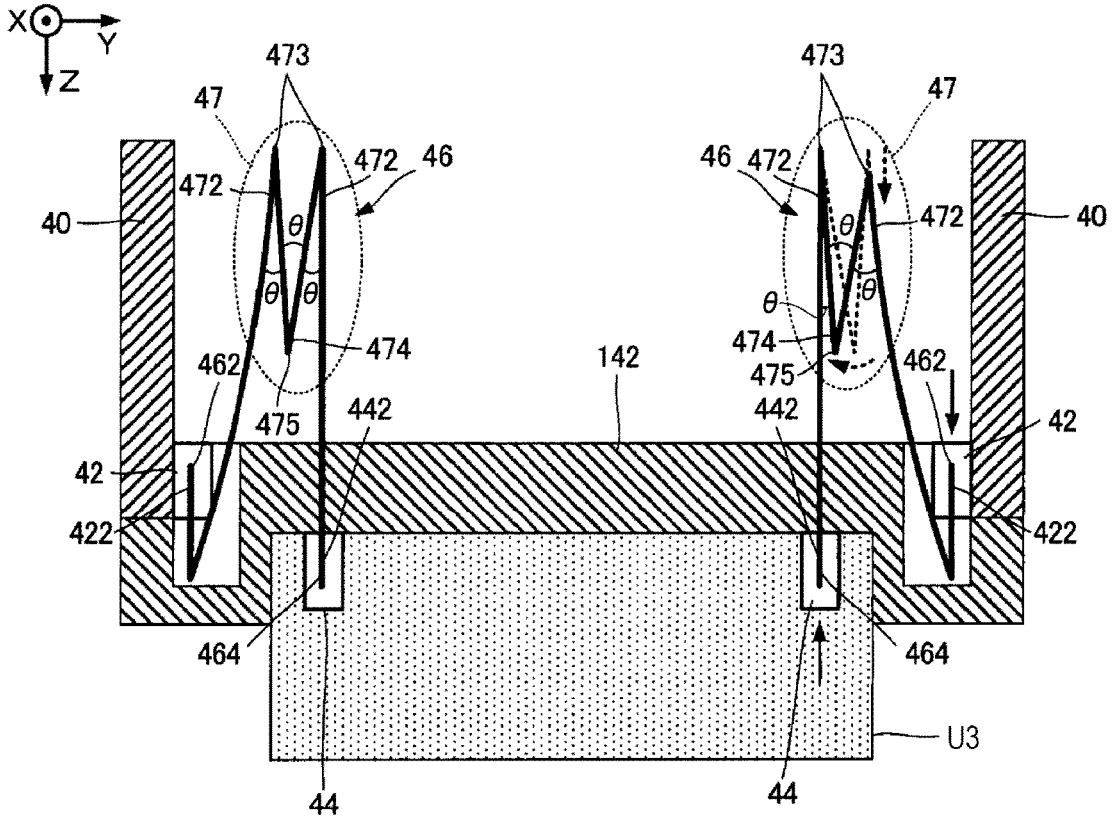
FIG. 11 is an explanatory view of an operation of the flexible wire illustrated in FIG. 10.

FIG. 11 is an explanatory view of an operation of the flexible wire 46 illustrated in FIG. 10. In FIG. 11, the dotted line indicates the flexible wire 46 before deformation and the solid line indicates the flexible wire 46 after deformation. For example, due to an installation error or the like, as indicated by the arrows in FIG. 11, even if the relative positions of the first electrical contact 42 and the second electrical contact 44 are changed in the Z direction, which is a first direction, and the relative positions of the two mountain-folded portions 472 are changed, the fold 475 of the valley-folded portion 474 moves in the Y direction in accordance with the relative positions, and thereby the bending stress generated in the flexible wire 46 can be reduced. Accordingly, the reaction force of the flexible wire 46 applied to the electrical contacts 42 and 44 can be reduced.

Furthermore, the structure in FIG. 10 has more folds in the folded portion 47 than that in FIG. 7. Accordingly, compared with the structure in FIG. 7, the folded portions (the valley-folded portion and the mountain-folded portions) 47 can be easily moved in the Y direction and Z direction. Accordingly, the structure in FIG. 10 can more easily reduce the bending stress generated in the flexible wire 46 than the structure in FIG. 7. It should be noted that more folds may be provided in the folded portion 47 than the structure in FIG. 10. As the number of folds in the folded portion 47 increases, the folded portion 47 becomes easier to be moved in various directions. Accordingly, the bending stress generated in the flexible wire 46 can be easily reduced.

Figure 12:
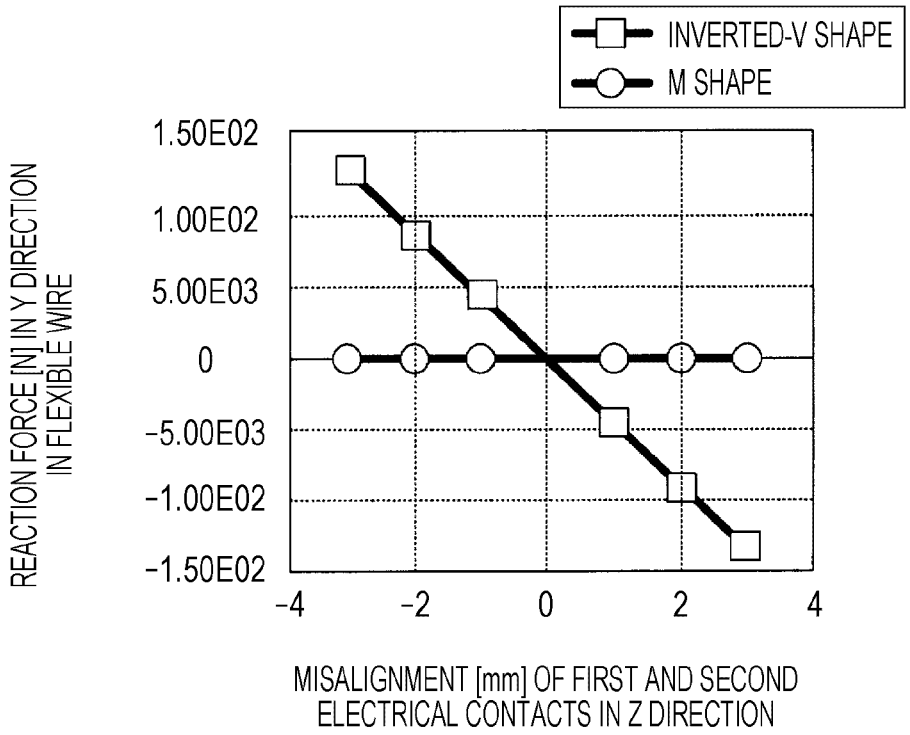
FIG. 12 illustrates the verification result of the effect of the embodiment.

FIG. 12 illustrates the verification result of the effect of the embodiment, and specifically, the verification result of the comparison of the effect in the flexible wire 46 (inverted-V shape) in FIG. 7 and the effect in the flexible wire 46 (M shape) in FIG. 10. FIG. 12 illustrates the verification of the change in the reaction force in the Y direction by the flexible wire 46 in a case where the relative misalignment of the electrical contacts 42 and 44 in the Z direction (first direction) was changed. The horizontal axis in FIG. 12 represents the relative misalignment [mm] of the first electrical contact 42 and the second electrical contact 44 in the Z direction. The vertical axis represents the reaction force [N] in the flexible wire 46 in the Y direction and "E" represents the index. The plot of the white squares is the flexible wire 46 (inverted-V shape) in FIG. 7 and the plot of the white circles is the flexible wire 46 (M shape) in FIG. 10.

FIG. 12 shows that as the relative misalignment of the electrical contacts 42 and 44 in the Z direction (first direction) increases, the reaction force in the flexible wire 46 (inverted-V shape) in FIG. 7 increases, whereas the reaction force in the flexible wire 46 (M shape) in FIG. 10 remains substantially zero. Accordingly, it is understood that the flexible wire 46 in FIG. 10 has greater stress reduction effect on the relative misalignment of the electrical contacts 42 and 44 in the Z direction. This is because, in the flexible wire 46 (M shape) in FIG. 10, the fold 475 of the valley-folded portion 474 is deformed to move, whereas the flexible wire 46 (inverted-V shape) in FIG. 7 is not provided with such a valley-folded portion 474. When a misalignment of the electrical contacts 42 and 44 in the Y direction (second direction) occurs, both structures in FIG. 7 and FIG. 10 are deformed to fold, and accordingly, not only the structure in FIG. 10, but also the structure in FIG. 7 has the effect of reducing the stress in the flexible wire 46.

Figure 13:
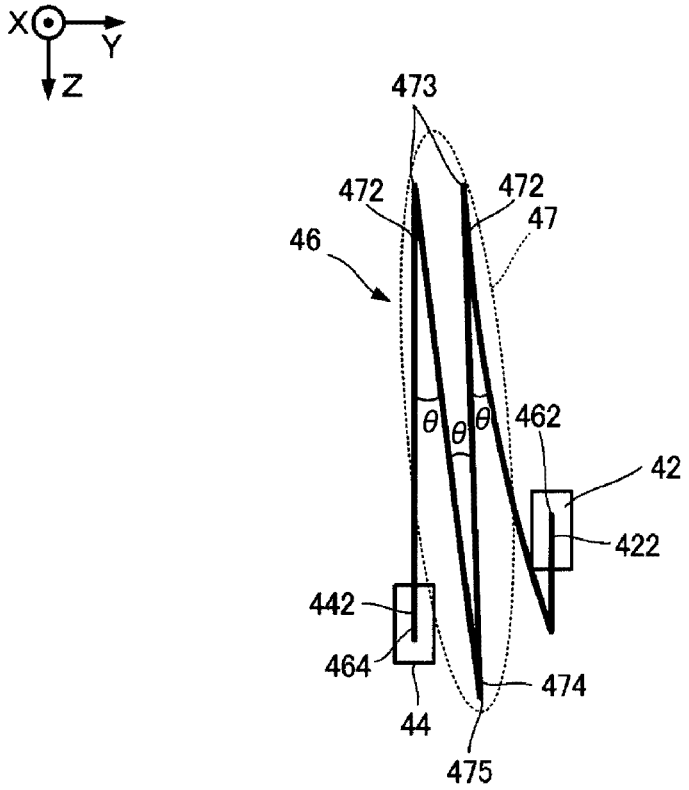
FIG. 13 illustrates a structure of a flexible wire according to a second modification.

As in a second modification of the embodiment in FIG. 13, the folded portion 47 may be designed such that, when viewed in the width direction of the flexible wire 46, in the Y direction (second direction), the folds 473 of the two mountain-folded portions 472 may be disposed apart, and in the Z direction (first direction), the fold 475 of the valley-folded portion 474 may be positioned on the opposite side of the folds 473 of the two mountain-folded portions 472 with the first electrical contact 42 therebetween. In such a structure, the length from the folds 473 of the mountain-folded portions 472 to the fold 475 of the valley-folded portion 474 is increased in the Z direction, and thereby the folded portion 47 can be easily folded. Consequently, the ease of assembly of the liquid discharge head 14 can be increased.

In the folded portion 47 in the flexible wire 46 in FIG. 10, the two folds 473 of the two mountain-folded portions 472 are disposed apart in the Y direction, and the folds 473 of the two mountain-folded portions 472 are provided between the first electrical contact 42 and the second electrical contact 44 in the Y direction. Accordingly, in the Y direction, the flexible wire 46 can be located between the first electrical contact 42 and the second electrical contact 44, and thereby the size of the liquid discharge head 14 can be reduced. Compared with the structure in FIG. 13 in which the fold 475 of the valley-folded portion 474 is located on the opposite side of the folds 473 of the two mountain-folded portions 472 with the first electrical contact 42 therebetween in the Z direction, the fold 475 of the valley-folded portion 474 can be easily moved. Consequently, the effect of reducing the reaction force of the flexible wire 46 applied to the electrical contacts 42 and 44 can be increased. With this structure, even if the electrical contacts 42 and 44 are misaligned largely, the reaction force of the flexible wire 46 applied to the electrical contacts 42 and 44 can be reduced.

Modifications

The above-described embodiments may be modified in various ways. Specific modifications will be described below. Two or more modifications selected from those below may be combined without a contradiction between them.

(1) In the structures in FIG. 7, FIG. 10, and FIG. 13, in the flexible wire 46, the rigidity of the folded portion 47 may be lower than that of the end portion 462, which is connected to the first electrical contact 42, and the end portion 464, which is connected to the second electrical contact 44. With this structure, the folded portion 47 can be folded easily. Accordingly, the effect of reducing the reaction force of the flexible wires 46 applied to the electrical contacts 42 and 44 can be increased.

(2) In the above-described embodiments, the example line head having the liquid discharge head 14 provided in the full width of the medium 11 has been described. Alternatively, the invention can be applied to a serial head that has a carriage in which the liquid discharge head 14 is mounted and is reciprocated in the X directions.

(3) In the above-described embodiments, the example piezoelectric liquid discharge head 14 that uses the piezoelectric element to apply mechanical vibrations to the pressure chamber has been described. Alternatively, a thermal liquid discharge head that uses a heating element to apply heat to generate bubbles in the pressure chamber may be employed.

(4) The liquid discharge apparatus in the above-described embodiments may be employed in devices dedicated for printing, and various devices such as facsimile apparatuses and copying machines. It should be noted that the usage of the liquid discharge apparatus according to the embodiments of the invention is not limited to printing. For example, the liquid discharge apparatus that discharges solutions of coloring materials can be used as manufacturing apparatuses for forming color filers for liquid crystal display apparatuses. Furthermore, the liquid discharge apparatus that discharges solutions of a conductive material can be used as manufacturing apparatuses for producing wires and electrodes of wiring boards.

This application claims priority to Japanese Patent Application No. 2016-216984 filed on Nov. 7, 2016. The entire disclosures of Japanese Patent Application No. 2016-216984 are hereby incorporated herein by reference.

What is claimed is:

1. A liquid discharge head comprising:

a first electrical contact and a second electrical contact disposed apart from each other;

a flexible wire connecting the first electrical contact and the second electrical contact to each other; and a drive element configured to generate a driving force for discharging liquid from nozzles in accordance with an electrical signal supplied via the first electrical contact, the flexible wire, and the second electrical contact, wherein the flexible wire has a folded portion being folded when viewed in a width direction of the flexible wire.

2. The liquid discharge head according to claim 1, wherein the folded portion has two mountain-folded portions and a valley-folded portion provided therebetween when viewed in the width direction of the flexible wire, and a fold of the valley-folded portion is configured to move in accordance with a relative positions of the folds of the two mountain-folded portions.

3. The liquid discharge head according to claim 2, wherein if a first direction and a second direction are orthogonal to each other when viewed in the width direction of the flexible wire, when the relative positions of the folds of the two mountain-folded portions are changed in the first direction, the fold of the valley-folded portion moves in the second direction.

4. The liquid discharge head according to claim 3, wherein in the second direction, the folds of the two mountain-folded portions are disposed apart, and in the first direction, the fold of the valley-folded portion is on the opposite side of the folds of the two mountain-folded portions with the first electrical contact therebetween.

5. The liquid discharge head according to claim 4, wherein a plurality of wiring structures each including the first electrical contact, the second electrical contact, and the flexible wire are provided, and the first electrical contacts in the wiring structures are provided on a common circuit board.

6. The liquid discharge head according to claim 4, further comprising:

a plurality of liquid discharge units each including the nozzles and the drive element; and a support supporting the liquid discharge units, wherein the first electrical contact is fixed to the support, and the second electrical contact is fixed to each of the liquid discharge units.

7. The liquid discharge head according to claim 4, wherein in the flexible wire, a rigidity of the folded portion is lower than that of an end portion connected to the first electrical contact and that of an end portion connected to the second electrical contact.

8. The liquid discharge head according to claim 3, wherein in the second direction, the folds of the two mountain-folded portions are disposed apart, and in the second direction, the folds of the two mountain-folded portions are between the first electrical contact and the second electrical contact.

9. The liquid discharge head according to claim 8, wherein a plurality of wiring structures each including the first electrical contact, the second electrical contact, and the flexible wire are provided, and the first electrical contacts in the wiring structures are provided on a common circuit board.

10. The liquid discharge head according to claim 8, further comprising:

a plurality of liquid discharge units each including the nozzles and the drive element; and a support supporting the liquid discharge units, wherein the first electrical contact is fixed to the support, and the second electrical contact is fixed to each of the liquid discharge units.

11. The liquid discharge head according to claim 8, wherein in the flexible wire, a rigidity of the folded portion is lower than that of an end portion connected to the first electrical contact and that of an end portion connected to the second electrical contact.

12. The liquid discharge head according to claim 3, wherein a plurality of wiring structures each including the first electrical contact, the second electrical contact, and the flexible wire are provided, and the first electrical contacts in the wiring structures are provided on a common circuit board.

13. The liquid discharge head according to claim 3, further comprising:

a plurality of liquid discharge units each including the nozzles and the drive element; and a support supporting the liquid discharge units, wherein the first electrical contact is fixed to the support, and the second electrical contact is fixed to each of the liquid discharge units.

14. The liquid discharge head according to claim 3, wherein in the flexible wire, a rigidity of the folded portion is lower than that of an end portion connected to the first electrical contact and that of an end portion connected to the second electrical contact.

15. The liquid discharge head according to claim 2, wherein a plurality of wiring structures each including the first electrical contact, the second electrical contact, and the flexible wire are provided, and the first electrical contacts in the wiring structures are provided on a common circuit board.

16. The liquid discharge head according to claim 15, further comprising:

a plurality of liquid discharge units each including the nozzles and the drive element; and a support supporting the liquid discharge units, wherein the first electrical contact is fixed to the support, and the second electrical contact is fixed to each of the liquid discharge units.

17. The liquid discharge head according to claim 15, wherein in the flexible wire, a rigidity of the folded portion is lower than that of an end portion connected to the first electrical contact and that of an end portion connected to the second electrical contact.

18. The liquid discharge head according to claim 2, further comprising:

a plurality of liquid discharge units each including the nozzles and the drive element; and a support supporting the liquid discharge units, wherein the first electrical contact is fixed to the support, and the second electrical contact is fixed to each of the liquid discharge units.

19. The liquid discharge head according to claim 2, wherein in the flexible wire, a rigidity of the folded portion is lower than that of an end portion connected to the first electrical contact and that of an end portion connected to the second electrical contact.

20. The liquid discharge head according to claim 1, wherein in a flexible wire, the rigidity of the folded portion is lower than that of an end portion connected to the first electrical contact and that of an end portion connected to the second electrical contact.

* * * * *